US006105675A

United States Patent [19]

Buytaert et al.

[11] Patent Number: 6,105,675

[45] Date of Patent: Aug. 22, 2000

[54] DOWNHOLE WINDOW MILLING APPARATUS AND METHOD FOR USING THE SAME

[75] Inventors: Jean P. Buytaert, Houston; Allen F. Bollinger, Spring, both of Tex.

[73] Assignee: Weatherford International, Inc., Houston, Tex.

[21] Appl. No.: 09/225,786

[22] Filed: Jan. 5, 1999

[51] Int. Cl.[7] ..... E21B 7/08

[52] U.S. Cl. ..... 166/298; 166/117.6

[58] Field of Search ..... 166/117.5, 55.1, 166/117.6, 117.7, 381, 382, 298

[56] References Cited

U.S. PATENT DOCUMENTS

| | | | |
|---|---|---|---|
| 5,429,187 | 7/1995 | Beagrie et al. | 166/55.1 |
| 5,566,762 | 10/1996 | Raddick et al. | 166/382 |
| 5,676,206 | 10/1997 | Rehbock et al. | 166/50 |
| 5,881,808 | 3/1999 | Rehbock et al. | 166/117.5 |
| 5,887,655 | 3/1999 | Haugen et al. | 166/298 |
| 5,911,275 | 6/1999 | McGarian et al. | 166/117.6 |

*Primary Examiner*—Frank Tsay
*Attorney, Agent, or Firm*—Howrey Simon Arnold & White, LLP

[57] ABSTRACT

A window milling device which parameters can be set, prior to running inside a casing, and once positioned at a proper location can assure accurate and constant milling parameters, independently from hole configuration and geometry. The assembly consists of an anchoring device, to which a whipstock is connected, and a milling bit attached to a motor, contained within a motor housing. The whipstock has a predetermined groove, and the motor housing is fitted with a mating key having a complimentary profile to the groove. Thus, when the mating key engages the groove, the motor housing travels down the whipstock to a predetermined location, where the milling of the wellbore casing commences.

14 Claims, 2 Drawing Sheets

DOWNHOLE WINDOW MILLING APPARATUS AND METHOD FOR USING THE SAME

FIELD OF THE INVENTION

This invention relates generally to petroleum drilling equipment, and in particular to an apparatus for milling a window in a wellbore casing. More particularly, a window milling apparatus using a downhole motor with a guide and key configuration which allows for more accurate and efficient milling of the casing is disclosed.

BACKGROUND OF THE INVENTION

Window milling is commonly used in the oil and gas industry to change the direction of an existing cased wellbore. A window may be milled, for example, in an existing casing string to enable a driller to sidetrack around the lower portion of the original well which is to be abandoned. With the evolution of extended reach and horizontal drilling technology, window milling has also been used in drilling multilateral wells. These multilateral wells allow a pre-existing well to reach new production zones for extracting oil and natural gas. This is accomplished by milling away a portion of the casing in such a way and an amount that a new wellbore can be drilled through the window. This technique may be repeated at different locations in the well until the well has several lateral wellbores extending into one or more production zones.

Horizontal or highly deviated wells and extended reach wells can present torque and drag related problems as the drill string lays on the low side of the casing. In such cases, it is difficult to transmit a constant rotation and weight from the surface to the milling bit. The present invention is directed to methods and apparatus for transmitting more accurate and constant rotation and weight to the milling bit, independently from hole configuration and geometry. The present invention differs from the prior art in that the milling bit is guided into a predetermined location before milling is begun. After the milling has started the bit maintains its position since the downhole motor it is attached to is secured to the whipstock.

It is a common problem in the prior art for downhole motors to generate reactive torque, which can cause the motor to jump out of the whipstock. This causes significant gyration in torque, damages the whipstock, motor and mill, and tears up the casing. With high deviation and extended reach wells, it is also difficult to accurately use surface parameters, such as the rotational speed and the weight on the bit, to control the window milling. The steel cuttings produced from milling the wellbore casing should be small enough to be easily circulated out of the wellbore, thus ensuring that the cuttings are not left in the hole or on the whipstock. Controlling the parameters downhole so that more uniform (i.e. small) cuttings are produced enables easy circulation of the cuttings out the well. The present invention addresses these problems by providing a window milling apparatus which utilizes a guide or rail to control the position of the milling bit with respect to the whipstock.

SUMMARY OF THE INVENTION

The invention is directed to a window milling assembly comprising an anchoring device, to which a whipstock is connected, and a milling bit attached to a downhole motor. The rotational speed of the milling bit will be determined by the selection of the downhole motor and the circulation rate of the drilling fluid through the motor. The weight on the milling bit can also be more accurately controlled from the surface by monitoring the mud pressure on the surface pressure gauge. Furthermore, a guide arrangement will keep the milling bit from engaging the whipstock. The present invention thus allows more accurate and efficient milling of the casing.

The constant rotation of the milling bit is assured by the downhole motor and is not affected by hole configuration. In the preferred embodiment, the downhole motor is a positive displacement mud motor. The motor may be lowered into the hole on drillpipe or coiled tubing. In order to prevent torque related problems, the downhole motor of one embodiment of the present invention incorporates an external dovetail shaped guide or key positioned on the outside diameter of the motor. This key will be engaged in a dovetail shaped groove machined in and extending longitudinally along the face of the whipstock, so that stator of the motor is guided for translation and cannot rotate. In the preferred embodiment, the whipstock is only used as a guide for the stator of the motor, and the sides of the milling bit do not touch the curved face of the whipstock, in order to prevent well known risks of milling the whipstock.

The key and groove arrangement helps guide the motor along the whipstock preventing any "jumping" effect which might occur as the result of the mill rotating against the face of the whipstock as well as the motor's reactive torque. Lateral loads from the milling bit are received by the radial bearing pack of the motor and not by the whipstock, which is, therefore, no longer subject to being milled. Pre-selection of milling parameters assure best possible milling performance as they take into account casing specifications, such as size, wall thickness and grade. By way of example, the desired rotational speed of the bit is set by selecting a downhole motor with known characteristics for a given flowrate and then pumping drilling fluids down the hole at that flowrate.

One aspect of the invention is directed to an apparatus for milling a window in a wellbore casing comprising a whipstock having a groove of a predetermined profile, a milling bit connected to the motor sub of a motor housing, and a means for connecting a key with a complimentary profile to the groove to the motor housing, the means having a width sufficient to prevent the milling bit from contacting the whipstock. The predetermined profile of the groove may be a dovetail, rectangular or spherical configuration. The means for connecting the key to the motor housing comprises a lug.

Another embodiment of the invention is directed to an apparatus for milling a window in a wellbore casing comprising a whipstock having a groove with a predetermined profile and a downhole motor connected to a milling bit wherein the motor includes a motor housing having a mating key with a complementary profile for engaging the groove to guide the motor with respect to the whipstock. An alternative embodiment of the invention is directed to an apparatus for milling a window in a wellbore casing comprising a whipstock having a rail on its face with a predetermined profile and a downhole motor connected to a milling bit wherein the motor includes a motor housing having a mating groove with a complementary profile for engaging the rail to guide the motor with respect to the whipstock. The predetermined profile of the rail has a dovetail, rectangular, or spherical configuration.

Another embodiment of the invention is directed to an apparatus for milling a window in a wellbore casing comprising a whipstock having a groove of a predetermined profile extending longitudinally along its face, a milling bit having an upper end and a lower end, a motor sub having an upper end and a lower end wherein its lower end is connected to the upper end of the milling bit, a motor housing connected to the upper end of the motor sub, a motor contained in the motor housing, and a means for connecting a key with a complimentary profile to the groove to the motor housing, the means having a width sufficient to prevent the milling bit from contacting the whipstock.

The present invention also includes a method of milling a window in a wellbore casing providing a whipstock with a groove of a predetermined profile on its face, connecting a motor housing to the whipstock by a key that is complimentary to the profile of the groove, connecting a milling bit to the motor housing, positioning the whipstock at a desired depth in the casing, allowing the milling bit and motor housing to travel down the groove in the whipstock, and milling a window in the casing with the milling bit.

BRIEF DESCRIPTION OF THE DRAWINGS

Other objects and advantages of the invention will become apparent upon reading the following detailed description and upon reference to the drawings in which.

Figure 1:
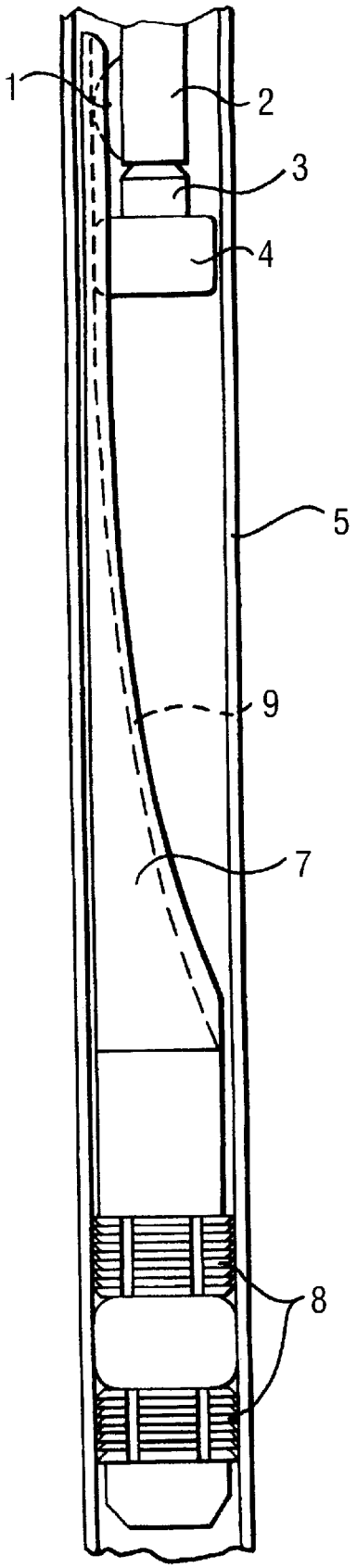
FIG. 1 is a side view of the window milling machine showing the casing whipstock and milling bit.

While the invention is susceptible to various modifications and alternative forms, specific embodiments thereof have been shown by way of example in the drawings and are herein described in detail. It should be understood, however, that the description herein of specific embodiments is not intended to limit the invention to the particular forms disclosed but, on the contrary, the invention is to cover all modifications, equivalents, and alternatives falling within the spirit and scope of the invention as defined by the appended claims.

DESCRIPTION OF THE PREFERRED EMBODIMENTS

Referring now to FIG. 1, it will been seen that the window milling apparatus is placed inside of the casing 5. The apparatus consists of a motor housing 2, a motor bit sub 3 and milling bit 4. A downhole motor (not shown) is enclosed in motor housing 2. Positive displacement mud motors are used in the preferred embodiment of the invention. Positive displacement mud motors are available in a wide range of single and multi-lobe models. The rotational speed of each model is known based on the flow rate of drilling fluids pumped through the motor. Thus, use of a positive displacement motor allows an operator to accurately adjust the downhole rotation of the milling bit from the surface by adjusting the flow rate of the drilling fluid. In addition, the mud pressure readings on the surface pressure gauge provides an indication of the weight on the milling bit when a positive displacement motor is used. For example, an increase in mud pressure for a given flowrate indicates that there is more torque being applied to the bit, which occurs when more weight has been applied to the bit. Conversely, a reduction of the surface mud pressure at a given flow rate indicates a decrease in the weight on bit. By maintaining a relatively constant mud pressure at the surface an operator can maintain a more consistent weight on the bit during the milling operations. Thus, monitoring the surface mud pressure allows an operator better control of the weight on the milling bit.

Any commercially available positive displacement mud motor may be used with the invention provided the housing is modified in accordance with the present invention. Commercially available milling bits may be used with the present invention. Preferably, a flat bottom milling bit may be used with the invention to cut a window in the casing.

Figure 2:
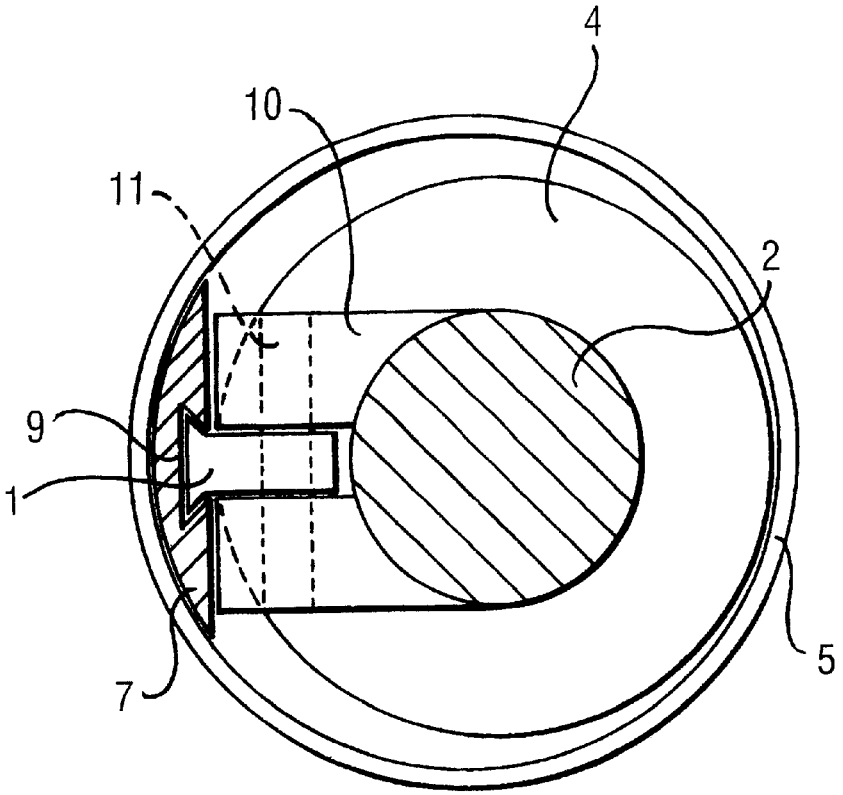
FIG. 2 is a plan view of the window milling machine shown in FIG. 1.
Figure 3:
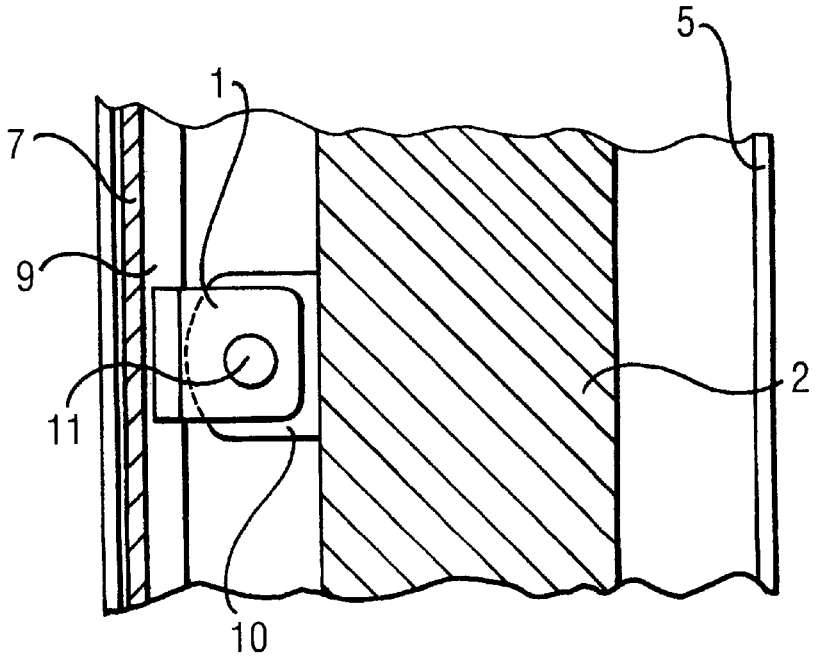
FIG. 3 is a close-up view of where the key intersects the groove.

The motor bit sub 3 connects the milling bit 4 to the motor housing 2. The motor housing is lowered into the wellbore on a drillstring (not shown) which may be comprised of drillpipe or coiled tubing. Also attached to the motor housing 2 is a key 1. Key 1 fits into the groove profile 9 on the face of the whipstock 7, thus securing the motor housing 2, to the whipstock 7. In a preferred embodiment, groove profile 9 is machined into the whipstock. The whipstock 7 is anchored in the casing 5 by an anchoring device 8. Any suitable whipstock packer may be used as the anchoring device. As can be seen in FIG. 2, mating key 1 fits into the dovetail groove 9 which then guides the milling bit 4 into a predetermined location on the casing 5. The key 1 is connected to lug 10 on motor housing 2 by retaining pin 11. The lug 10 may be attached to motor housing 2 by welding, fasteners, clamps or other known means or may be integral to the housing. As can be seen in FIG. 3, the lug 10 is of a sufficient width that, while the key 1 is engaged with the groove 9, the motor housing 2 and milling bit 4 (not shown) do not contact the whipstock 7.

In a preferred embodiment, the packer 8 is run into the wellbore casing 5. The packer includes a mule shoe female receptacle on top (not shown). When the desired depth is reached, the packer is oriented in the desired direction and set. The whipstock, positive displacement mud motor and milling bit are then run into the wellbore as a single assembly with the key on the motor housing located in the groove profile on the whipstock. Preferably, the motor housing is secured to the top of the whipstock by a plurality of shear screws. The bottom of the whipstock includes a mule shoe (not shown) which is latched inside the mule shoe receptacle located on top of the packer. The mule shoe arrangement orients the whipstock in the desired direction. The shear screws are sheared by applying weight to the drillstring. The mud pumps are turned on and the surface pressure is noted at various flow rates to check the parameters of the motor. After the desired flow rate is selected, the motor is lowered until the mud pressure at the surface starts to increase. The increased mud pressure reflects an increase in the torque caused by the milling bit engaging the inside diameter of the casing. Weight is gradually added to the milling bit and the progress of the milling operation is monitored. Milling operations continue until the key, or guide, on the motor housing reaches the end of the groove profile on the face of the whipstock. The well is circulated to remove the milled cuttings out of the wellbore. The motor and bit are then pulled out of the hole and laid down. The window may be enlarged by running in the hole with an assembly comprising, for example, a tapered mill, a short drill collar and a full gauge watermelon mill and by reaming up and down through the window with the assembly until the torque is negligible. The well may then be circulated again to clean the cuttings out of the hole. After the milling assembly has been pulled out of the hole, a new section of wellbore may be drilled through the window.

The foregoing description of the invention has been directed to a particular embodiment for purposes of explanation and illustration. It will be apparent, however, to those skilled in the art that modifications to the apparatus described may be made without departing from the essence of the invention. Such modifications may include, but are not limited to, different profiles for the key and groove on the whipstock and motor housing. For example, rectangular or spherical configurations can be used on the key and groove instead of the dovetail configuration shown in FIG. 2. Alternatively, a guide rail may be placed on the whipstock which engages a mating groove located on the exterior of the motor housing, or on a lug connected to the motor housing. Those skilled in the art will recognize that various substitutions and modifications may be made to the invention without departing from the scope and spirit of the invention as recited in the appended claims.

What is claimed is:

1. An apparatus for milling a window in a wellbore casing comprising:

a whipstock having a groove of a predetermined profile;

a milling bit connected to the motor sub of a motor housing; and a means for connecting a key with a complimentary profile to the groove to the motor housing, the means having a width sufficient to prevent the milling bit from contacting the whipstock.

2. An apparatus as in claim 1, wherein the means for connecting the key to the motor housing comprises a lug.

3. An apparatus as in claim 1 or 2, wherein the predetermined profile of the groove has a dovetail, rectangular or spherical configuration.

4. An apparatus for milling a window in a wellbore casing comprising:

a whipstock having a groove of a predetermined profile extending longitudinally along its face;

a milling bit having an upper end and a lower end;

a motor sub having an upper end and lower end, its lower end connected to the upper end of the milling bit;

a motor housing connected to the upper end of the motor sub;

a downhole motor contained in the motor housing; and a means for connecting a key with a complimentary profile to the groove to the motor housing, the means having a width sufficient to prevent the milling bit from contacting the whipstock.

5. An apparatus as in claim 4, wherein the means for connecting comprises a lug.

6. An apparatus as in claim 4 or 5, wherein the predetermined profile of the groove has a dovetail, rectangular or spherical configuration.

7. An apparatus as in claim 4, wherein the downhole motor is a positive displacement mud motor.

8. An apparatus for milling a window in a wellbore casing comprising:

a whipstock having a groove with a predetermined profile; and a downhole motor connected to a milling bit wherein the motor includes a motor housing having a mating key with a complimentary profile for engaging the groove to guide the motor with respect to the whipstock.

9. An apparatus as in claim 8, wherein the predetermined profile of the groove has a dovetail, rectangular or spherical configuration.

10. An apparatus as in claim 8, wherein the downhole motor is a positive displacement mud motor.

11. An apparatus for milling a window in a wellbore casing comprising:

a whipstock having a rail on its face with a predetermined profile; and a downhole motor connected to a milling bit wherein the motor includes a motor housing having a mating groove with a complimentary profile for engaging the rail to guide the motor with respect to the whipstock.

12. An apparatus as in claim 11, wherein the predetermined profile of the rail has a dovetail, rectangular or spherical configuration.

13. An apparatus as in claim 11, wherein the downhole motor is a positive displacement mud motor.

14. A method of milling a window in a wellbore casing comprising:

providing a whipstock with a groove of a predetermined profile on its face;

connecting a motor housing to the whipstock by a key that is complimentary to the profile of the groove;

connecting a milling bit to a downhole motor in the motor housing;

positioning the whipstock at a desired depth in the casing;

allowing the milling bit and motor housing to travel down the groove in the whipstock; and milling a window in the casing with the milling bit.

* * * * *